US007242396B2

(12) United States Patent
Tai et al.

(10) Patent No.: US 7,242,396 B2
(45) Date of Patent: Jul. 10, 2007

(54) METHOD OF CHARGING LIQUID CRYSTAL DISPLAY DEVICE

(75) Inventors: Ya-Hsiang Tai, Maio-Li County (TW); Chaung-Ming Chiu, Maio-Li County (TW)

(73) Assignee: TPO Displays Corp. (TW)

( * ) Notice: Subject to any disclaimer, the term of this patent is extended or adjusted under 35 U.S.C. 154(b) by 745 days.

(21) Appl. No.: 10/714,616

(22) Filed: Nov. 18, 2003

(65) Prior Publication Data

US 2005/0102787 A1 May 19, 2005

(51) Int. Cl.
*G09G 5/00* (2006.01)

(52) U.S. Cl. ..... 345/204; 345/87

(58) Field of Classification Search ..... 345/87, 345/88, 89, 90–100, 204
See application file for complete search history.

(56) References Cited

U.S. PATENT DOCUMENTS 3,891,981 A * 6/1975 Torresi ..... 345/89
6,501,453 B1 * 12/2002 Wong ..... 345/90
7,109,958 B1 * 9/2006 Martin ..... 345/87
2003/0034828 A1 * 2/2003 Matsumoto ..... 327/536
2005/0024547 A1 * 2/2005 Park ..... 349/39
2005/0134545 A1 * 6/2005 Jang et al. ..... 345/100

* cited by examiner

*Primary Examiner*—Nitin Patel
(74) *Attorney, Agent, or Firm*—Finnegan, Henderson, Farabow, Garrett & Dunner LLP

(57) ABSTRACT

A method of charging a liquid crystal display (LCD) device that includes providing a plurality of scan lines, providing a plurality of video lines formed orthogonal to the scan lines, providing a plurality of cells, each cell including a transistor and a capacitor coupled to the transistor, each of the cells being formed at an intersection of the scan lines and video lines, providing a periodic signal for writing video data into the LCD device, charging the plurality of cells having first-type transistors during a first half cycle of the periodic signal until a first voltage level of the periodic signal is reached, charging the plurality of cells having second-type transistors during a second half cycle of the periodic signal until a second voltage level of the periodic signal is reached, and discharging the plurality of cells to a predetermined voltage level.

20 Claims, 2 Drawing Sheets

METHOD OF CHARGING LIQUID CRYSTAL DISPLAY DEVICE

DESCRIPTION

1. Technical Field

This invention pertains in general to a liquid crystal display. ("LCD") device and, more particularly, to a method of charging an LCD device.

2. Background

Amorphous silicon thin film transistor liquid crystal ("α-Si TFT-LCD") devices and low temperature poly-silicon ("LTPS") devices generally include a matrix of cells for actuating display of an image. A cell is formed adjacent to each intersection of a plurality of scan lines and a plurality of video lines formed approximately orthogonal to the scan lines. Each cell is equivalent to a transistor and a capacitor having one end coupled to the transistor and the other end coupled to a common voltage. The transistor of a cell is turned on when a scan pulse of a high voltage level is applied to a scan line coupled to the gate of the transistor so that a video signal, for example, a voltage signal, is applied over a video line to which the transistor is coupled to charge a capacitor of the cell. When a scan pulse of a low voltage level is applied to the transistor, the transistor is turned off and the capacitor maintains the charge until a next scan pulse of a high voltage level occurs. Since the scan pulse and the video signal are typically generated by an alternating current ("AC") voltage source, the amount of charge on a cell is able to be periodically refreshed.

In the aforementioned LCD devices, each cell is coupled to a pixel electrode formed on one transparent substrate. A liquid crystal layer is disposed between the pixel electrode and a counter electrode, for example, an indium-tin oxide ("ITO") electrode, formed on an opposing transparent substrate. The common voltage is provided by a direct current ("DC") voltage source, and is usually applied to a counter electrode of the LCD device. The video signal is written to a cell to build a pixel potential. The absolute value of the difference between a pixel potential of a pixel electrode and a common potential of a counter electrode determines an electrical field applied to the liquid crystal layer.

The display quality of an LCD device may be judged by whether the cells of the LCD device are able to correctly maintain the applied voltage and whether the cells have a fast response time. Therefore, it is a continuing effort to fabricate a TFT-LCD device or an LTPS LCD device with a shorter response time, in addition to a larger display panel and a finer resolution of image. To charge a cell to a target voltage, some conventional techniques are process oriented, and may include improving process parameters such as TFT channel width over length (W/L) ratio, capacitance of gate oxide ($C_{ox}$), threshold voltage ($V_{th}$) and operation voltage. Other conventional techniques are circuit oriented, and are focused on how to pre-charge a cell before it is charged to a target value. A circuit-oriented technique generally implements one of three methods.

The first method of a circuit-oriented technique pre-charges a cell to a DC common voltage of, for example, approximately 5.2 V (volts). The cell is pre-charged until the common voltage is reached during a first half cycle of a square-wave video signal in which the voltage level of the video signal is lower than the DC common voltage, for example, from approximately 1.5 V to 4.2 V. The cell is pre-charged, specifically discharged, to the DC common voltage during a second half cycle of the video signal in which the voltage level of the video signal is higher than the DC common voltage, for example, from approximately 6.2 V to 8.9 V. In this method, the video signal has a maximum voltage level of approximately 8.9 V and a minimum voltage level of approximately 1.5 V.

The second method of a circuit-oriented technique pre-charges a cell to a maximum or minimum voltage level of a video signal. Specifically, the cell is pre-charged until the maximum voltage level, approximately 8.9 V, of the video signal is reached during the second half cycle of the video signal. The cell is then pre-charged, or discharged, until the minimum voltage level, approximately 1.5 V, of the video signal is reached during the first half cycle of the video signal.

The third method of a circuit-oriented technique pre-charges a cell to a critical voltage level that may initiate a change in the gray scale of a pixel. Specifically, the cell is pre-charged until a voltage level, for example, 7.4 V, between a maximum voltage level of 8.9 V and the common voltage level of 5.2 V, is reached during the second half cycle of the video signal. The difference between the voltage level of 7.4 V and the common voltage of 5.2 V is minimum required potential to build an electrical field to affect liquid crystal molecules in the liquid crystal layer in a first direction, resulting in a change in the gray scale of a pixel. The cell is then pre-charged until a voltage level, for example, 3.4 V, between a minimum voltage level of 1.5 V and the common voltage of 5.2 V, is reached during the first half cycle of the video signal. Likewise, the difference between the voltage level of 3.4 V and the common voltage of 5.2 V is the minimum required potential to affect the liquid crystal molecules in the liquid crystal layer in a second direction opposite to the first direction, resulting in a change in the gray scale of a pixel.

SUMMARY OF THE INVENTION

Accordingly, the present invention is directed to methods that obviate one or more of the problems due to limitations and disadvantages of the related art.

Additional features and advantages of the present invention will be set forth in the description which follows, and in part will be apparent from the description, or may be learned by practice of the invention. The objectives and other advantages of the invention will be realized and attained by the methods particularly pointed out in the written description and claims thereof, as well as the appended drawings.

To achieve these and other advantages, and in accordance with the purpose of the invention as embodied and broadly described, there is provided a method of charging a liquid crystal display (LCD) device that includes providing a plurality of scan lines, providing a plurality of video lines formed orthogonal to the scan lines, providing a plurality of cells, each cell including a transistor and a capacitor coupled to the transistor, each of the cells being formed at an intersection of the scan lines and video lines, providing a periodic signal for writing video data into the LCD device, charging the plurality of cells having first-type transistors during a first half cycle of the periodic signal until a first voltage level of the periodic signal is reached, charging the plurality of cells having second-type transistors during a second half cycle of the periodic signal until a second voltage level of the periodic signal is reached, and discharging the plurality of cells to a predetermined voltage level.

In one aspect, the method further includes providing the periodic signal with a voltage level ranging from approximately 1.5 V to 4.2 V during the first half cycle of the periodic signal.

In another aspect, the method further includes providing the periodic signal with a voltage level ranging from approximately 6.2 V to 8.9 V during the second half cycle of the periodic signal.

Also in accordance with the present invention, there is provided a method of charging a liquid crystal display (LCD) device that includes providing a plurality of scan lines, providing a plurality of video lines formed orthogonal to the scan lines, providing a plurality of cells, each of the cells being formed at an intersection of the scan lines and video lines and including a transistor and a capacitor, one end of the capacitor being coupled to the transistor and another end being coupled to a common voltage level, providing a signal for writing video data into the LCD device, the signal having a first voltage level and a second voltage level, providing one of pre-charging the cells during a first half cycle of the signal until the first voltage level of the signal is reached, or pre-charging the cell during a second half cycle of the periodic signal until the second voltage level of the periodic signal is reached, and discharging the cells to a predetermined voltage level.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate embodiments consistent with the invention and, together with the description, serve to explain the objects, advantages, and principles of the invention.

In the drawings.

DESCRIPTION OF THE EMBODIMENTS

Reference will now be made in detail to embodiments consistent with the invention, examples of which are illustrated in the accompanying drawings. Wherever possible, the same reference numbers will be used throughout the drawings to refer to the same or like parts.

Figure 1:
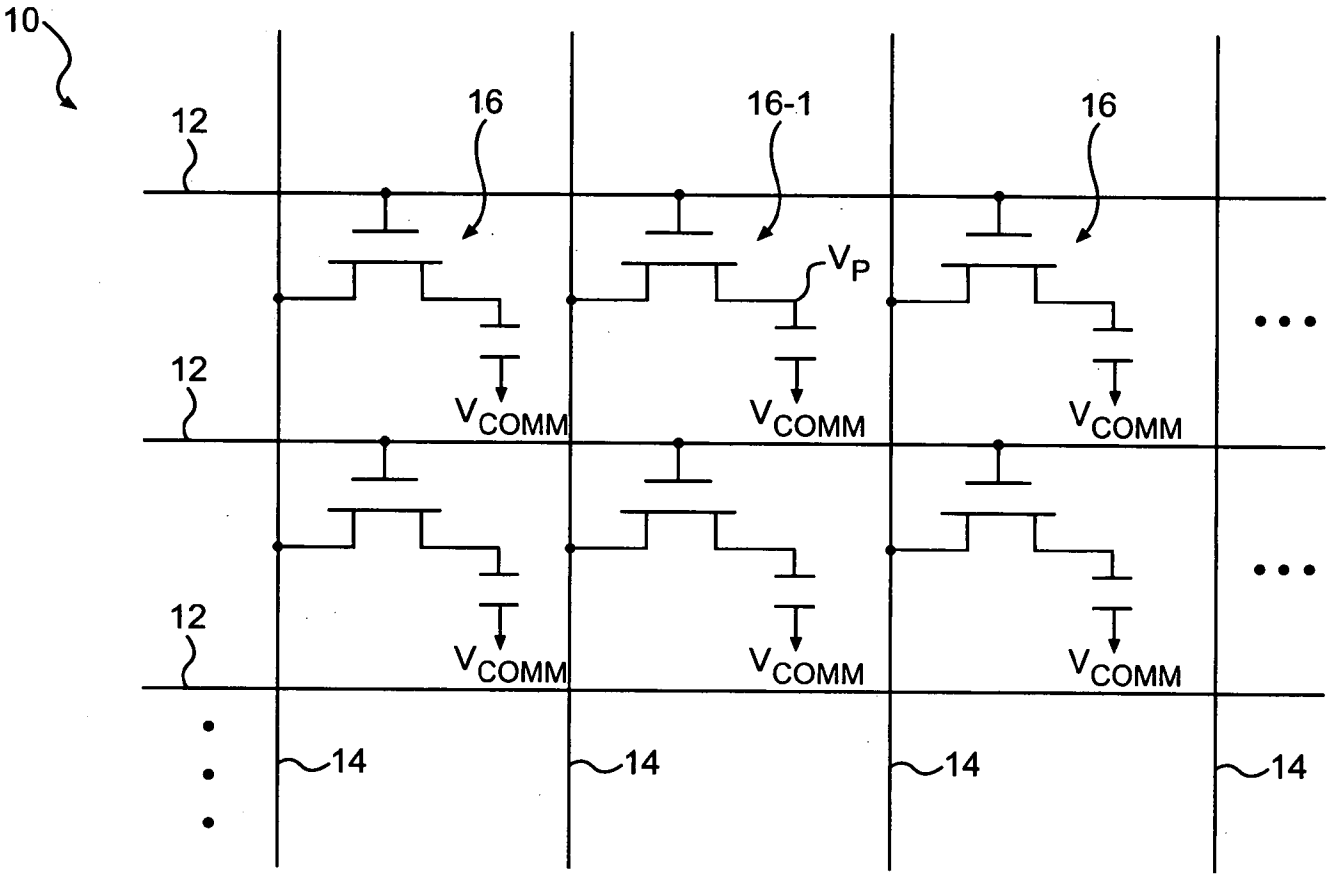
FIG. 1 shows a layout of a cell matrix consistent with one embodiment of the present invention.

The present invention provides a method for quick charging a cell to reduce the response time of pixels. FIG. 1 shows a layout of a cell matrix of an LCD device 10 consistent with one embodiment of the present invention. Referring to FIG. 1, LCD device 10 includes a plurality of scan lines 12, a plurality of video lines 14 formed orthogonal to scan lines 12, and a matrix of cells 16, each formed at an intersection of scan lines 12 and video lines 14. A representative cell 16-1 includes a transistor (not numbered) and a capacitor (not numbered). The transistor of cell 16-1 includes a gate (not numbered) coupled to one of scan lines 12, a first terminal (not numbered), for example, a source, coupled to one of video lines 14, and a second terminal (not numbered), for example, a drain, coupled to one end (not numbered) of the capacitor. The other end of the capacitor is coupled to a common voltage level $V_{COMM}$. In one embodiment, common voltage level $V_{COMM}$ has a voltage level of approximately 5.2 V. As the gate of cell 16-1 is turned on by a scan pulse provided over scan line 12, a video signal is written over video line 14 to the first terminal and then to the second terminal of the transistor, resulting in a voltage level $V_P$ at the one end of the capacitor. The difference between $V_P$ and $V_{COMM}$ determines the gray scale of a pixel (not shown) of LCD device 10 associated with cell 16-1.

In charging cell 16-1, a charging current $I_d$ is determined by a gate voltage $V_g$, a source voltage $V_s$ and a drain voltage $V_d$ of the transistor, and may be expressed by an equation as follows:

$$I_d=\mu\times(W/L)\times C_{ins}\times(V_{gs}-V_{th})\times V_{ds}$$

wherein μ is permeability of silicon, W and L are a channel width and channel length of a transistor, respectively, $C_{ins}$ is the capacitance of a gate insulating material, $V_{gs}$ is the voltage difference between $V_g$ and $V_s$, $V_{th}$ is a threshold voltage of the transistor, and $V_{ds}$ is the voltage difference between $V_d$ and $V_s$. The parameters μ, W/L ratio, $C_{ins}$, and $V_{th}$ are all associated predominately with process-oriented techniques and are not discussed further herein.

For a circuit-oriented method, the charging current $I_d$ is a function of $V_{gs}$. Specifically, when the gate voltage $V_g$ approaches the source voltage $V_s$, $V_{gs}$ becomes smaller, resulting in a smaller charging current $I_d$ and hence a longer charging time. $V_{gs}$ may be expressed in an equation as follows:

$$V_{gs}=V_{g,on}-(\mathrm{Min}[V_{video}, V_p])$$

wherein $V_{g,on}$ is an operation voltage of a transistor, and $V_{video}$ is a periodic signal applied over video lines 14 to LCD device 10. In one embodiment, $V_{g,on}$ is approximately 12 V. In addition, $V_{video}$ is a square-wave signal having a first voltage level of approximately 1.5 V, and a second voltage level of approximately 8.9 V. The periodic signal $V_{video}$ includes a first half cycle having a voltage level ranging from approximately 1.5 V to 4.2 V, and a second half cycle having a voltage level ranging form approximately 6.2 V to 8.9 V. In addition, since $V_p$ is written by $V_{video}$, $V_p$ ranges from approximately 1.5 V to 8.9 V. The term $\mathrm{Min}[V_{video}, V_p]$ indicates that $V_{video}$ and $V_p$ are compared against each other to determine a source voltage.

During the first half cycle of the periodic signal $V_{video}$, supposing that $V_{video}$ is approximately 1.5 V, $V_{gs}$ is equal to $V_{g,on}$ (12 V)−$V_{video}$(1.5 V), i.e., 10.5 V, which is sufficient to provide a charging current $I_d$. During the second half cycle of the periodic signal $V_{video}$, however, $V_{gs}$ may become smaller as $V_{video}$ approaches $V_p$. For example, supposing that $V_{video}$ is approximately 8.9 V and $V_p$ is approximately 7.4 V, $V_{gs}$ is equal to $V_{g,on}$ (12 V)−$V_p$(7.4 V), i.e., 4.6 V. In this case, $V_{gs}$ becomes increasingly smaller than 4.6 V as $V_p$ is charged to $V_{video}$, resulting in a smaller charging current $I_d$ and a longer charging time. On the contrary, supposing that $V_{video}$ is approximately 7.4 V and $V_p$ is approximately 8.9 V, $V_{gs}$ is equal to $V_{g,on}$ (12 V)−$V_{video}$ (7.4 V), i.e., 4.6 V. In this case, due to the fact that capacitor discharging is quicker than charging, $V_{gs}$ becomes increasingly greater than 4.6 V as $V_p$ is discharged to $V_{video}$, resulting in a greater charging current $I_d$ and a shorter charging time than when $V_p$ is charged to $V_{video}$.

Figure 2A:
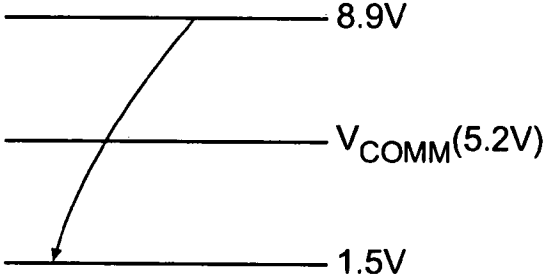
FIGS. 2A and 2B show a method of charging an LCD device in accordance with one embodiment of the present invention.
Figure 2B:
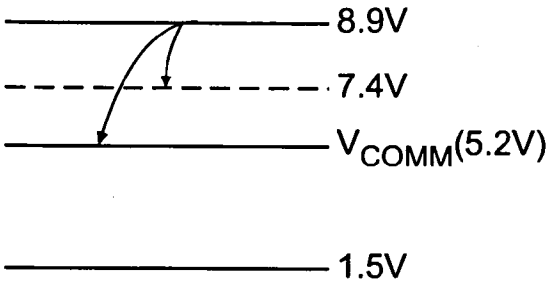

Therefore, the present invention takes the advantage of the above fact that discharging a cell is more advantageous than charging the cell. FIGS. 2A and 2B schematically show a method in accordance with one embodiment of the present invention. Referring to FIG. 2A, the method includes providing a periodic signal for writing video data into an LCD device. During the first half cycle of the periodic signal, i.e., the periodic signal having a voltage level ranging from approximately 1.5 V to 4.2 V, the method pre-charges a cell of the LCD device having p-type transistors until the first voltage level, i.e., approximately 1.5 V, of the periodic signal is reached, as indicated by the path of the arrow. The cell is then able to be discharged from the first voltage level of approximately 1.5 V to a predetermined voltage level.

Referring to FIG. 2B, during the second half cycle of the periodic, signal, i.e., the periodic signal having a voltage level ranging from approximately 6.2 V to 8.9 V, the method may take no further action, pre-charge the cell to a common voltage level of approximately 5.2 V, or pre-charge the cell to a critical voltage level of 7.4 V. The critical voltage level refers to a voltage level that initiates a change in the gray scale of a pixel. The cell is then discharged to a predetermined voltage level.

Figure 3A:
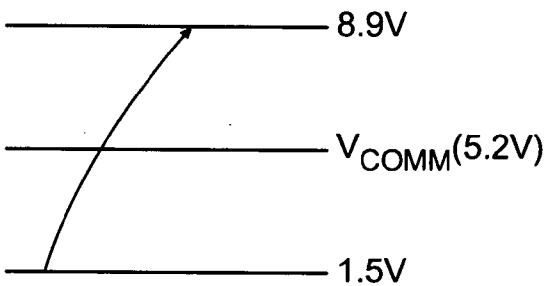
FIGS. 3A and 3B show a method of charging an LCD device in accordance with another embodiment of the present invention.
Figure 3B:
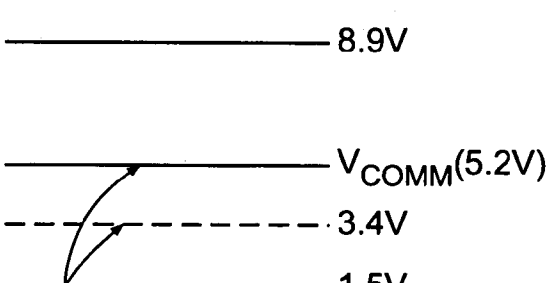

FIGS. 3A and 3B schematically show a method in accordance with another embodiment of the present invention. Referring to FIG. 3A, the method includes providing a periodic signal for writing video data into an LCD device. During the second half cycle of the periodic signal, i.e., the periodic signal having a voltage level ranging from approximately 6.2 V to 8.9 V, the method pre-charges a cell of the LCD device having n-type transistors until the second voltage level, i.e, 8.9 V, of the periodic signal is reached. The cell is then able to be discharged from the second voltage level of approximately 8.9 V to a predetermined voltage level.

Referring to FIG. 3B, during the first half cycle of the periodic signal, i.e., the periodic signal having a voltage level ranging from approximately 1.5 V to 4.2 V, the method of the present invention may either take no further action, pre-charge the cell to a common voltage level of approximately 5.2V, or to another critical voltage level of approximately 3.4 V. The cell is then discharged to a predetermined voltage level.

A simulation test shows that one conventional method requires approximately 710 nanoseconds (ns) to pre-charge a cell to a critical voltage level of 7.4 V and then charge to a pre-determined voltage level of 8.9 V. A second conventional method requires approximately 544 ns to pre-charge a cell to a voltage level of approximately 8.9 V and then maintain the cell at approximately 8.9 V. In contrast, a method of the present invention requires only approximately 460 ns to pre-charge a cell to a voltage level of approximately 8.9 V and then discharge the cell to a voltage level of approximately 6.2 V.

It will be apparent to those skilled in the art that various modifications and variations can be made in the disclosed process without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of charging a liquid crystal display (LCD) device, comprising:

providing a plurality of scan lines;

providing a plurality of video lines formed orthogonal to the scan lines;

providing a plurality of cells, each cell including a transistor and a capacitor coupled to the transistor, each of the cells being formed at an intersection of the scan lines and video lines;

providing a periodic signal for writing video data into the LCD device;

charging the plurality of cells having first-type transistors during a first half cycle of the periodic signal until a first voltage level of the periodic signal is reached;

charging the plurality of cells having second-type transistors during a second half cycle of the periodic signal until a second voltage level of the periodic signal is reached; and discharging the plurality of cells to a predetermined voltage level.

2. The method of claim 1, further comprising providing the periodic signal as a square-wave signal.

3. The method of claim 1, further comprising providing the periodic signal with a first voltage level of approximately 1.5 V.

4. The method of claim 1, further comprising providing the periodic signal with a second voltage level of approximately 8.9 V.

5. The method of claim 1, further comprising coupling at least one capacitor of the plurality of cells to a common voltage level of approximately 5.2 V.

6. The method of claim 1, where the first-type transistors are p-type transistors.

7. The method of claim 1, wherein the second-type transistors are n-type transistors.

8. The method of claim 6, further comprising providing the periodic signal with a voltage level ranging from approximately 1.5 V to 4.2 V during the first half cycle of the periodic signal.

9. The method of claim 7, further comprising providing the periodic signal with a voltage level ranging from approximately 6.2 V to 8.9 V during the second half cycle of the periodic signal.

10. The method of claim 6, further comprising pre-charging the cells to a common voltage level during the second half cycle of the periodic signal.

11. The method of claim 6, further comprising pre-charging the cells to a voltage level between a common voltage level and the first voltage level during the second half cycle of the periodic signal.

12. The method of claim 7, further comprising pre-charging the cells to a common voltage level during the first half cycle of the periodic signal.

13. The method of claim 7, further comprising pre-charging the cells to a voltage level between a common voltage level and the first voltage level during the first half cycle of the periodic signal.

14. A method of charging a liquid crystal display (LCD) device, comprising:

providing a plurality of scan lines;

providing a plurality of video lines formed orthogonal to the scan lines;

providing a plurality of cells, each of the cells being formed at an intersection of the scan lines and video lines and including a transistor and a capacitor, one end of the capacitor being coupled to the transistor and another end being coupled to a common voltage level;

providing a signal for writing video data into the LCD device, the signal having a first voltage level and a second voltage level;

providing one of pre-charging the cells during a first half cycle of the signal until the first voltage level of the signal is reached, or pre-charging the cell during a second half cycle of the periodic signal until the second voltage level of the periodic signal is reached; and discharging the cells to a predetermined voltage level.

15. The method of claim 14, wherein the signal is a square-wave signal.

16. The method of claim 14, further comprising providing the signal with a first voltage level of approximately 1.5 V.

17. The method of claim 14, further comprising providing the signal with a second voltage level of approximately 8.9 V.

18. The method of claim 14, further comprising coupling at least one of the capacitors to a common voltage level of approximately 5.2 V.

19. The method of claim 14, wherein at least one of the transistors is an n-type transistor.

20. The method of claim 14, wherein at least one of the transistors is a p-type transistor.

* * * * *